US008365499B2

(12) United States Patent
Nilsson et al.

(10) Patent No.: US 8,365,499 B2
(45) Date of Patent: Feb. 5, 2013

(54) RESILIENT FLOOR

(75) Inventors: Mats Nilsson, Viken (SE); Per Nygren, Ramlösa (SE)

(73) Assignee: Valinge Innovation AB, Viken (SE)

( * ) Notice: Subject to any disclaimer, the term of this patent is extended or adjusted under 35 U.S.C. 154(b) by 120 days.

(21) Appl. No.: 12/875,293

(22) Filed: Sep. 3, 2010

(65) Prior Publication Data

US 2011/0056167 A1 Mar. 10, 2011

Related U.S. Application Data

(60) Provisional application No. 61/239,927, filed on Sep. 4, 2009.

(51) Int. Cl.
*E04C 1/00* (2006.01)

(52) U.S. Cl. ..... 52/747.1; 52/592.1

(58) Field of Classification Search ..... 52/747.11, 52/745.2, 747.1, 591.1, 592.1, 592.4, 582.2
See application file for complete search history.

(56) References Cited

U.S. PATENT DOCUMENTS

| | | | | |
|---|---|---|---|---|
| 213,740 | A | 4/1879 | Conner | |
| 2,306,295 | A | 12/1942 | Casto | |
| 2,497,837 | A | 2/1950 | Nelson | |
| 2,740,167 | A | 4/1956 | Rowley | |
| 2,863,185 | A | 12/1958 | Riedi | |
| 2,872,712 | A | 2/1959 | Brown | |
| 2,947,040 | A | 8/1960 | Schultz | |
| 3,055,461 | A | 9/1962 | De Ridder | |
| 3,259,417 | A | 7/1966 | Chapman | |
| 3,397,496 | A | 8/1968 | Sohns | |
| 4,100,710 | A | 7/1978 | Kowallik | |
| 4,242,390 | A | 12/1980 | Nemeth | |
| 4,299,070 | A | 11/1981 | Oltmanns et al. | |
| 4,574,099 | A | 3/1986 | Nixon | |
| 4,807,412 | A * | 2/1989 | Frederiksen | 52/177 |
| 4,944,514 | A | 7/1990 | Suiter | |
| 5,050,362 | A | 9/1991 | Tal et al. | |
| 5,134,026 | A | 7/1992 | Melcher | |
| 5,185,193 | A | 2/1993 | Phenicie et al. | |
| 5,295,341 | A | 3/1994 | Kajiwara | |
| 5,333,429 | A | 8/1994 | Cretti | |
| 5,348,778 | A | 9/1994 | Knipp et al. | |
| 5,349,796 | A | 9/1994 | Meyerson | |
| 5,433,806 | A | 7/1995 | Pasquali et al. | |
| 5,502,939 | A | 4/1996 | Zadok et al. | |
| 5,694,730 | A | 12/1997 | Del Rincon et al. | |
| 5,706,621 | A | 1/1998 | Pervan | |
| 5,755,068 | A | 5/1998 | Ormiston | |
| 5,797,237 | A * | 8/1998 | Finkell, Jr. | 52/589.1 |

(Continued)

FOREIGN PATENT DOCUMENTS

| | | | |
|---|---|---|---|
| CA | 2 252 791 | C | 5/2004 |
| CN | 2106197 | U | 6/1992 |

(Continued)

OTHER PUBLICATIONS

U.S. Appl. No. 13/343,439, Pervan.

(Continued)

*Primary Examiner* — Brian Glessner
*Assistant Examiner* — Adriana Figueroa
(74) *Attorney, Agent, or Firm* — Buchanan Ingersoll & Rooney

(57) ABSTRACT

A method of assembling resilient floorboards is disclosed that includes the step of bending an edge of a floorboard during the assembling. The bending reduces the force required for connection of the edge to another edge of a juxtaposed floorboard.

34 Claims, 9 Drawing Sheets

U.S. PATENT DOCUMENTS

| | | | | |
|---|---|---|---|---|
| 5,858,160 | A | 1/1999 | Piacente et al. | |
| 5,900,099 | A | 5/1999 | Sweet et al. | |
| 6,006,486 | A | 12/1999 | Moriau et al. | |
| 6,101,778 | A | 8/2000 | Martensson | |
| 6,139,945 | A | 10/2000 | Krejchi et al. | |
| 6,233,899 | B1 * | 5/2001 | Mellert et al. | 52/747.1 |
| 6,314,701 | B1 | 11/2001 | Meyerson | |
| 6,324,809 | B1 | 12/2001 | Nelson | |
| 6,332,733 | B1 * | 12/2001 | Hamberger et al. | 403/329 |
| 6,345,481 | B1 | 2/2002 | Nelson | |
| 6,363,677 | B1 | 4/2002 | Chen et al. | |
| 6,505,452 | B1 | 1/2003 | Hannig et al. | |
| 6,546,691 | B2 * | 4/2003 | Leopolder | 52/747.1 |
| 6,591,568 | B1 | 7/2003 | Palsson et al. | |
| 6,617,009 | B1 | 9/2003 | Chen et al. | |
| 6,672,030 | B2 * | 1/2004 | Schulte | 52/747.1 |
| 6,695,944 | B2 | 2/2004 | Courtney | |
| 6,766,622 | B1 | 7/2004 | Thiers | |
| 6,769,218 | B2 | 8/2004 | Pervan | |
| 6,786,019 | B2 | 9/2004 | Thiers | |
| 6,851,237 | B2 | 2/2005 | Niese et al. | |
| 6,854,235 | B2 | 2/2005 | Martensson | |
| 6,874,291 | B1 | 4/2005 | Weber | |
| 6,880,305 | B2 | 4/2005 | Pervan et al. | |
| 6,880,307 | B2 | 4/2005 | Schwitte et al. | |
| 6,898,911 | B2 | 5/2005 | Kornfalt et al. | |
| 6,922,965 | B2 | 8/2005 | Rosenthal et al. | |
| 6,955,020 | B2 | 10/2005 | Moriau et al. | |
| 6,966,963 | B2 | 11/2005 | O'Connor | |
| 7,090,430 | B1 * | 8/2006 | Fletcher et al. | 404/35 |
| 7,121,058 | B2 | 10/2006 | Palsson et al. | |
| 7,137,229 | B2 | 11/2006 | Pervan | |
| 7,152,383 | B1 | 12/2006 | Wilkinson | |
| 7,171,791 | B2 * | 2/2007 | Pervan | 52/592.1 |
| 7,454,875 | B2 * | 11/2008 | Pervan et al. | 52/586.2 |
| 7,516,588 | B2 | 4/2009 | Pervan | |
| 7,533,500 | B2 | 5/2009 | Morton | |
| 7,543,418 | B2 | 6/2009 | Weitzer | |
| 7,568,322 | B2 | 8/2009 | Pervan | |
| 7,584,583 | B2 | 9/2009 | Bergelin et al. | |
| 7,739,849 | B2 * | 6/2010 | Pervan | 52/582.1 |
| 7,779,597 | B2 * | 8/2010 | Thiers et al. | 52/588.1 |
| 7,802,415 | B2 | 9/2010 | Pervan et al. | |
| 7,886,497 | B2 | 2/2011 | Pervan | |
| 7,930,862 | B2 * | 4/2011 | Bergelin et al. | 52/316 |
| 7,958,689 | B2 | 6/2011 | Lei | |
| 7,980,043 | B2 | 7/2011 | Moebus | |
| 7,984,600 | B2 * | 7/2011 | Alford et al. | 52/588.1 |
| 8,021,741 | B2 | 9/2011 | Chen et al. | |
| 8,028,486 | B2 | 10/2011 | Pervan et al. | |
| 8,245,478 | B2 | 8/2012 | Bergelin et al. | |
| 2002/0046433 | A1 | 4/2002 | Sellman, Jr. et al. | |
| 2002/0092263 | A1 * | 7/2002 | Schulte | 52/747.1 |
| 2002/0100231 | A1 | 8/2002 | Miller et al. | |
| 2002/0170259 | A1 | 11/2002 | Ferris | |
| 2002/0178674 | A1 | 12/2002 | Pervan | |
| 2002/0178681 | A1 | 12/2002 | Zancai et al. | |
| 2003/0154676 | A1 | 8/2003 | Schwartz | |
| 2004/0031227 | A1 | 2/2004 | Knauseder | |
| 2004/0049999 | A1 | 3/2004 | Krieger | |
| 2004/0068954 | A1 | 4/2004 | Martensson | |
| 2004/0107659 | A1 | 6/2004 | Glockl | |
| 2004/0139678 | A1 | 7/2004 | Pervan | |
| 2004/0177584 | A1 | 9/2004 | Pervan | |
| 2004/0182036 | A1 | 9/2004 | Sjöberg et al. | |
| 2004/0211143 | A1 | 10/2004 | Hannig | |
| 2004/0211144 | A1 | 10/2004 | Stanchfield | |
| 2004/0255541 | A1 | 12/2004 | Thiers et al. | |
| 2005/0055943 | A1 | 3/2005 | Pervan | |
| 2005/0138881 | A1 | 6/2005 | Pervan | |
| 2005/0160694 | A1 | 7/2005 | Pervan | |
| 2005/0166514 | A1 | 8/2005 | Pervan | |
| 2006/0099386 | A1 | 5/2006 | Smith | |
| 2006/0101769 | A1 | 5/2006 | Pervan et al. | |
| 2006/0144004 | A1 | 7/2006 | Nollet et al. | |
| 2006/0156666 | A1 | 7/2006 | Caufield | |
| 2007/0028547 | A1 | 2/2007 | Grafenauer et al. | |
| 2007/0175143 | A1 | 8/2007 | Pervan et al. | |
| 2007/0175156 | A1 | 8/2007 | Pervan et al. | |
| 2008/0005989 | A1 | 1/2008 | Pervan et al. | |
| 2008/0029490 | A1 * | 2/2008 | Martin et al. | 219/117.1 |
| 2008/0134607 | A1 | 6/2008 | Pervan et al. | |
| 2008/0134613 | A1 | 6/2008 | Pervan | |
| 2008/0138560 | A1 | 6/2008 | Windmoller | |
| 2008/0241440 | A1 | 10/2008 | Bauer | |
| 2008/0263975 | A1 | 10/2008 | Mead | |
| 2009/0133353 | A1 * | 5/2009 | Pervan et al. | 52/588.1 |
| 2009/0151290 | A1 | 6/2009 | Liu | |
| 2009/0193748 | A1 * | 8/2009 | Boo et al. | 52/589.1 |
| 2009/0235604 | A1 | 9/2009 | Cheng et al. | |
| 2010/0011695 | A1 | 1/2010 | Cheng et al. | |
| 2010/0242398 | A1 | 9/2010 | Cullen | |
| 2011/0041996 | A1 | 2/2011 | Pervan | |
| 2011/0131901 | A1 | 6/2011 | Pervan et al. | |
| 2011/0154763 | A1 | 6/2011 | Bergelin et al. | |
| 2012/0124932 | A1 | 5/2012 | Schulte et al. | |

FOREIGN PATENT DOCUMENTS

| | | | |
|---|---|---|---|
| CN | 1270263 | A | 10/2000 |
| DE | 35 38 538 | A1 | 5/1987 |
| DE | 42 42 530 | A1 | 6/1994 |
| DE | 295 17 995 | U1 | 3/1996 |
| DE | 198 54 475 | A1 | 7/1999 |
| DE | 200 02 744 | U1 | 9/2000 |
| DE | 100 01 248 | A1 | 7/2001 |
| DE | 100 32 204 | C1 | 7/2001 |
| DE | 202 06 460 | U1 | 8/2002 |
| DE | 103 16 695 | A1 | 10/2004 |
| DE | 10 2004 001 363 | A1 | 8/2005 |
| DE | 198 54 475 | B4 | 6/2006 |
| DE | 10 2005 024 366 | A1 | 11/2006 |
| EP | 0 665 347 | A1 | 8/1995 |
| EP | 0 903 451 | A2 | 3/1999 |
| EP | 0 903 451 | A3 | 8/1999 |
| EP | 1 045 083 | A1 | 10/2000 |
| EP | 1 045 083 | B1 | 10/2002 |
| EP | 1 262 609 | A1 | 12/2002 |
| EP | 1 350 904 | A2 | 10/2003 |
| EP | 1 350 904 | A3 | 10/2003 |
| EP | 1 357 239 | A2 | 10/2003 |
| EP | 1 357 239 | A3 | 10/2003 |
| EP | 1 640 530 | A2 | 3/2006 |
| GB | 2 117 813 | A | 10/1983 |
| GB | 2 243 381 | A | 10/1991 |
| JP | 59-185346 | U | 12/1984 |
| JP | 1-178659 | A | 7/1989 |
| JP | 5-96282 | U | 12/1993 |
| JP | 6-39840 | B2 | 5/1994 |
| JP | 7-26467 | U | 5/1995 |
| JP | 7-180333 | A | 7/1995 |
| JP | 8-086080 | A | 4/1996 |
| JP | 8-109734 | A | 4/1996 |
| JP | 9-53319 | A | 2/1997 |
| JP | 11-131771 | A | 5/1999 |
| KR | 1996-0005785 | | 7/1996 |
| KR | 10 2007 0000322 | A | 1/2007 |
| WO | WO 94/01628 | A2 | 1/1994 |
| WO | WO 94/26999 | A1 | 11/1994 |
| WO | WO 97/47834 | A1 | 12/1997 |
| WO | 2 252 791 | A1 | 5/1999 |
| WO | WO 99/58254 | A1 | 11/1999 |
| WO | WO 99/66151 | A1 | 12/1999 |
| WO | WO 99/66152 | A1 | 12/1999 |
| WO | WO 00/22225 | A1 | 4/2000 |
| WO | WO 00/47841 | A1 | 8/2000 |
| WO | WO 00/66856 | A1 | 11/2000 |
| WO | WO 01/51732 | A1 | 7/2001 |
| WO | WO 01/53628 | A1 | 7/2001 |
| WO | WO 01/75247 | A1 | 10/2001 |
| WO | WO 01/77461 | A1 | 10/2001 |
| WO | WO 02/055809 | A1 | 7/2002 |
| WO | WO 02/055810 | A1 | 7/2002 |
| WO | WO 02/060691 | A1 | 8/2002 |
| WO | WO 02/092342 | A1 | 11/2002 |
| WO | WO 03/012224 | A1 | 2/2003 |
| WO | WO 03/016654 | A1 | 2/2003 |
| WO | WO 03/025307 | A1 | 3/2003 |

| | | | |
|---|---|---|---|
| WO | WO 03/078761 | A1 | 9/2003 |
| WO | WO 2004/053257 | A1 | 6/2004 |
| WO | WO 2004/079130 | A1 | 9/2004 |
| WO | WO 2004/053257 | A8 | 12/2004 |
| WO | WO 2005/068747 | A1 | 7/2005 |
| WO | WO 2006/043893 | A1 | 4/2006 |
| WO | WO 2006/104436 | A1 | 10/2006 |
| WO | WO 2007/089186 | A1 | 8/2007 |
| WO | WO 2008/008824 | A1 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/133377 | A1 | 11/2008 |
| WO | WO 2008/142538 | A2 | 11/2008 |

OTHER PUBLICATIONS

Pervan, Darko, U.S. Appl. No. 13/343,439, entitled "Floorboard and Method for Manufacturing Thereof," filed in the U. S. Patent and Trademark Office on Jan. 4, 2012.

U.S. Appl. No. 13/596,988, Pervan.

U.S. Appl. No. 13/615,081, Pervan.

Pervan, Darko, U.S. Appl. No. 13/596,988, entitled "Mechanical Locking System for Floor Panels," filed in the U.S. Patent and Trademark Office on Aug. 28, 2012.

Pervan, Darko, et al, U.S. Appl. No. 13/615,081, entitled "Floorboard, System and Method for Forming a Flooring, and a Flooring Formed Thereof," filed in the U.S. Patent and Trademark Office on Sep. 13, 2012.

U.S. Appl. No. 13/552,357, Bergelin, et al.

Bergelin, Marcus, et al., U.S. Appl. No. 13/552,357 entitled "Resilient Groove," filed in the U.S. Patent and Trademark Office on Jul. 18, 2012.

* cited by examiner

RESILIENT FLOOR

CROSS-REFERENCE TO RELATED APPLICATIONS

This application claims benefit to Application No. 61/239,927, filed Sep. 4, 2009. Application No. 61/239,927 is hereby incorporated by reference in its entirety.

TECHNICAL FIELD

The present invention generally concerns a method of assembling of floorboards provided with a mechanical locking system.

BACKGROUND OF THE INVENTION

Floorboards with a wood based core that are provided with a mechanical locking system and methods of assembling such floorboards by angling-angling, angling-snapping or vertical folding are disclosed in e.g. WO 94/26999, WO 01/77461, WO 2006/043893 and WO 01/75247. Floorboards of resilient material, e.g. PVC, are known, commonly referred to as LVT (Luxury Vinyl Tiles) that are glued down to the subfloor or bonded at the edges to each other WO 2008/008824.

SUMMARY OF THE INVENTION

A method is disclosed for assembling of floorboards, which are so called resilient floorboards i.e. the core is of a resilient material for example vinyl or PVC. The known methods of assembling floorboards that are mentioned above are difficult to use when assembling resilient floorboards since resilient floorboards easily bend which make it hard to use the angling-angling method and it is unfeasible to use the angling-snapping method since it requires a force to be applied, at an opposite edge in relation to the edge of the floorboard which is intended to be connected, by e.g. a hammer and a tapping block and the resilient core of the resilient floorboard absorbs the applied force. The known vertical folding methods are also difficult to apply due to the increased friction in the resilient material. The disclosed method makes the assembling easier and reduces the force needed for connection of the floorboards.

Furthermore, a locking system suitable for the method is disclosed. The locking system decreases the friction forces that must be overcome when installing the resilient floorboards.

An aspect of the invention is a method of assembling resilient floorboards, which are provided with a mechanical locking system, which method comprises the step of:

- positioning a floorboard edge, provided with a first device of said mechanical locking system (11), juxtaposed another floorboard edge, provided with a second device of said mechanical locking system (11)
- bending (30) the floorboard (2) along the edge
- applying a force (F) on a first part of the floorboard edge, wherein at said first part of the floorboard edge said first device is pushed into said second device to obtain a vertical and horizontal mechanical locking of a part of the floorboards' edges.

The bending makes it possible to finalize the connection of only a part of the edge of the floorboard, instead of the whole edge as in the known methods, and consequently the force needed to assemble the floorboards is considerably reduced.

The bending is preferably achieved by raising an outer part of said edge preferably by positioning of a raising device, e.g. a wedge, or a hand/finger of the assembler under said floorboard. The raised position of the outer part of said edge is preferably maintained during the force-applying step. In a preferred embodiment also the position of the raising device is maintained during the force-applying step.

The method comprises thereafter preferably the step of applying a force to a new part of the edge, which new part is adjacent to the mechanically locked part, and repeating this step until the whole edge is connected to said another edge.

The force is preferably applied by a tool and most preferably by a tool with a rotatable part.

In a preferred embodiment, the first device is an upper locking strip, which is resiliently bendable, with a downwardly protruding locking element and the second device is a lower locking strip provided with an upwardly protruding locking element. The resiliently bendable locking strip facilitates the connection of the floorboards. The downwardly protruding locking element is provided with a locking surface, which cooperates, for horizontal locking, with a locking surface of the upwardly protruding locking element. The locking strips are integrally formed with the resilient floorboards and preferably of the same resilient material. The downwardly and/or the upwardly protruding locking element is preferably provided with a guiding surface which are configured to guide the locking elements in to a position were the floorboards are connected by the locking elements and the locking surfaces cooperate.

The resilient floorboards are in a preferred embodiment made of a bendable thermo plastic, e.g. vinyl, surlyn, and PVC. Floorboards of vinyl are generally referred to as LVT (Luxury Vinyl Tiles). In a most preferred embodiment the thickness of the floorboard is about 4 mm to about 10 mm. If the floorboards are too thin it is hard to produce a locking system integrally in the floorboard material and if they are too thick it is hard to assemble the floorboards with the disclosed method.

The floorboards are in a preferred embodiment provided with an upper decorative layer made of a similar resilient material and most preferably provided with a balancing layer and/or a sublayer.

The force is preferably applied with a tool, which comprises a handle and a press part for applying a force on the floorboard. Preferably, the press part is provided with an outer round or circular shape for applying the force on the floorboard and in the most preferred embodiment the press part is rotatable.

DETAILED DESCRIPTION OF EMBODIMENTS

Figure 1A:
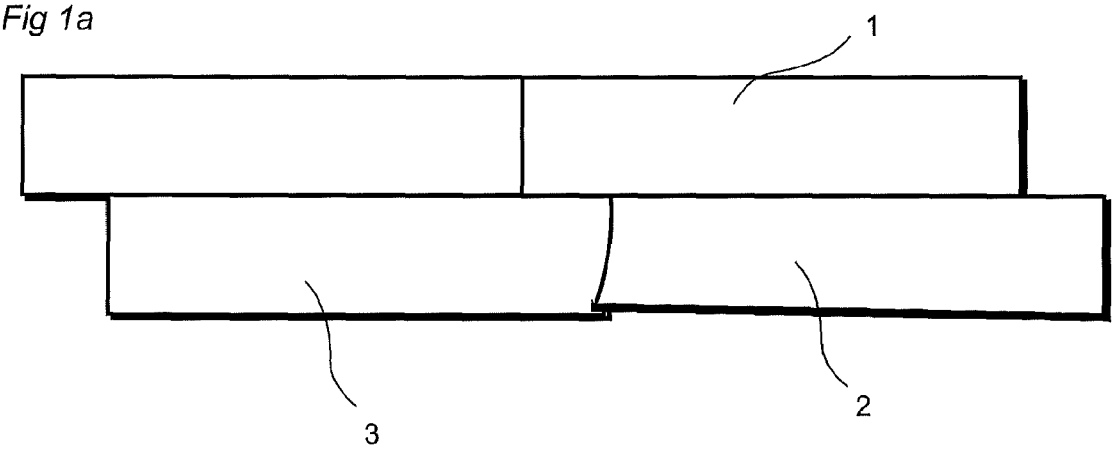
FIGS. 1*a*-*b* show an embodiment of the assembling method.
Figure 1B:
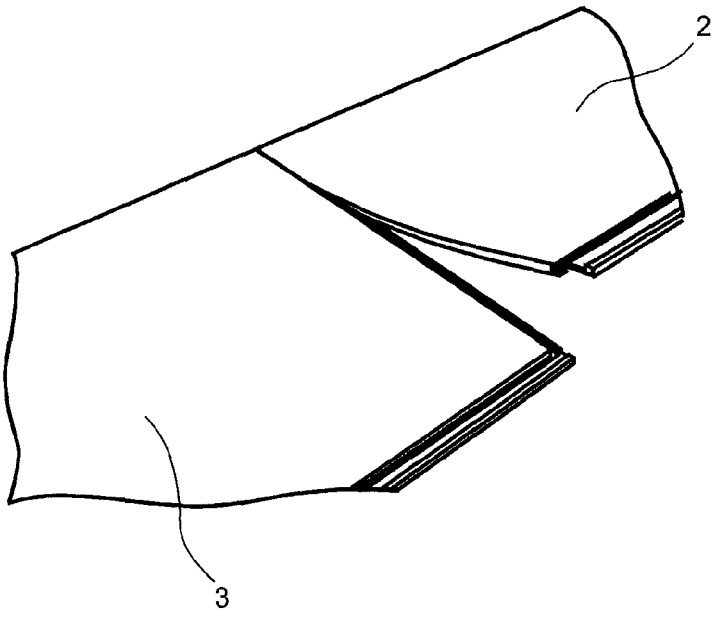

An embodiment of a method of assembling resilient floorboards (1, 2, 3) with a mechanical locking system 11 is shown in FIGS. 1*a* and 1*b*. An edge of a floorboard 2 is positioned juxtaposed another edge of another floorboard 3. The edge of the floorboard is bent (30) along the edge during the assembling and the connection of the floorboard edges to each other. In this embodiment the edge and said another edge are short edges and a long edge of the floorboard is connected to a long edge of a floorboard 1 in another row, by a mechanical angling locking system, simultaneous with the short edge connection, by an angular motion.

Figure 5A:
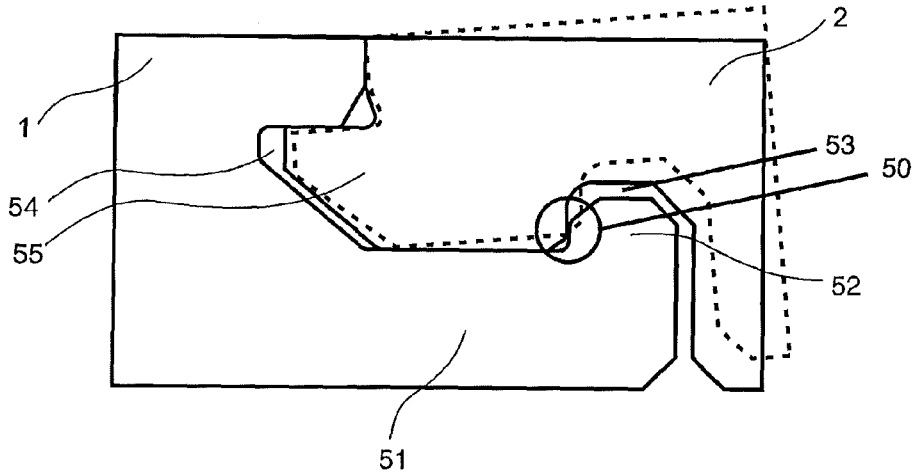
FIGS. 5*a*-5*b* show an embodiment of a locking system configured for connection by angling.
Figure 5B:
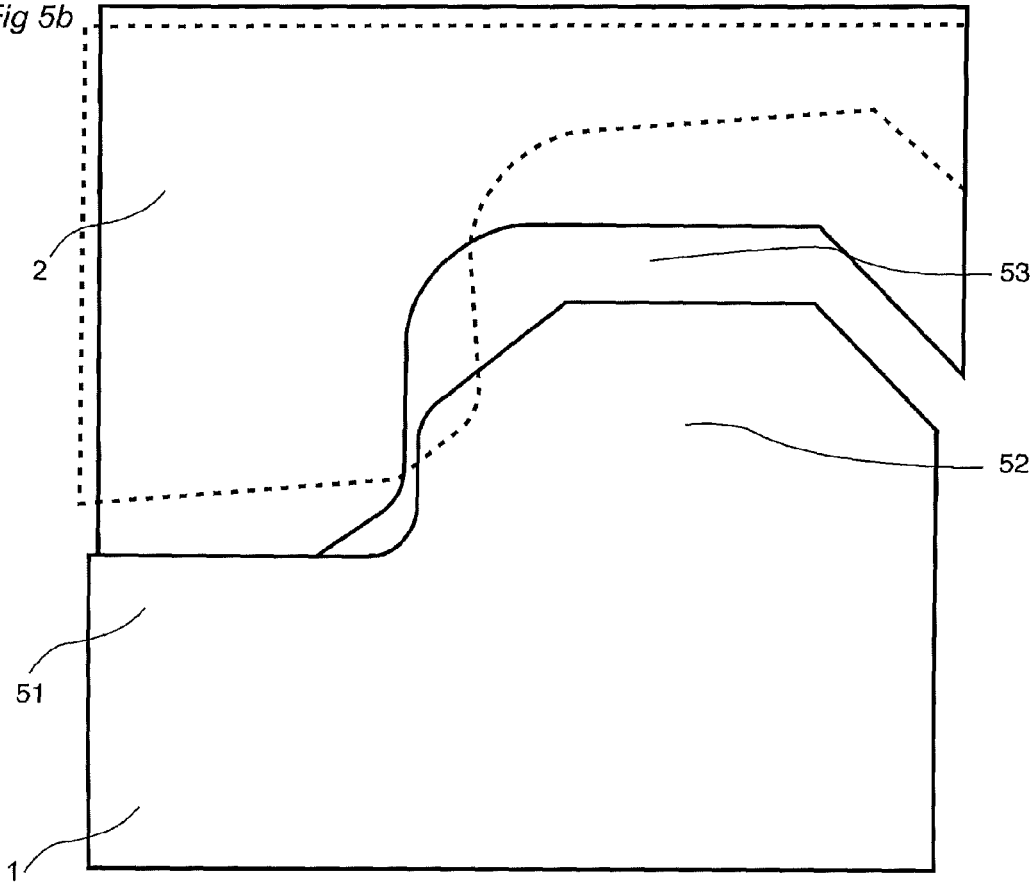

An embodiment of a mechanical angling locking system is shown in FIGS. 5*a* and 5*b*. Embodiments of the mechanical locking system 11 at the short edges is shown in FIGS. 6*a* to 9*a*. When assembling a complete floor the method shown in FIG. 1*a* is naturally applied and repeated for each resilient floorboard, which is provided with the locking system at each short edge and the mechanical angling locking system at each long side, until all resilient floorboards are connected.

The resilient floorboards may also be of square shape with the mechanical locking system 11 provided at two opposite edges of each floorboard and the mechanical angling locking system provided at two other opposite edges of each floorboard. It is also possible to provide floorboards of rectangular shape with the mechanical locking system 11 at the long edges and the mechanical angling locking system at the short edges.

Figure 2A:
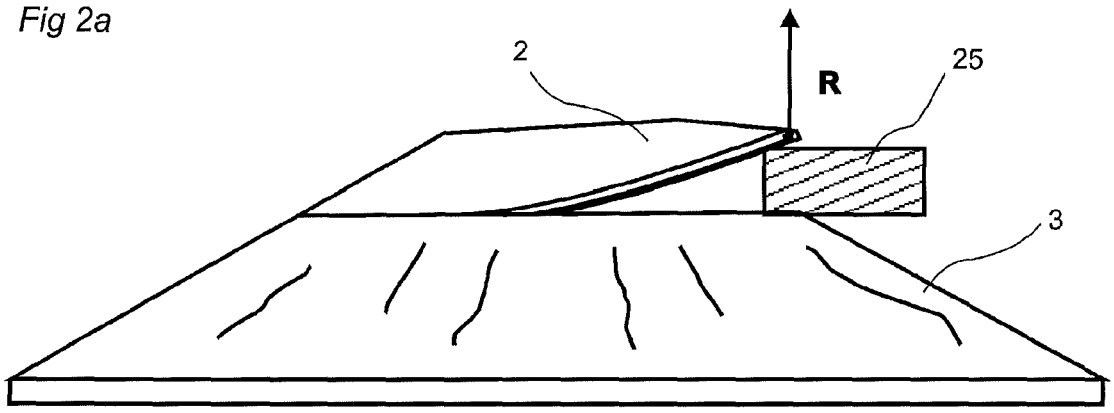
FIGS. 2*a*-2*b* show an embodiment of the assembling method.
Figure 2B:
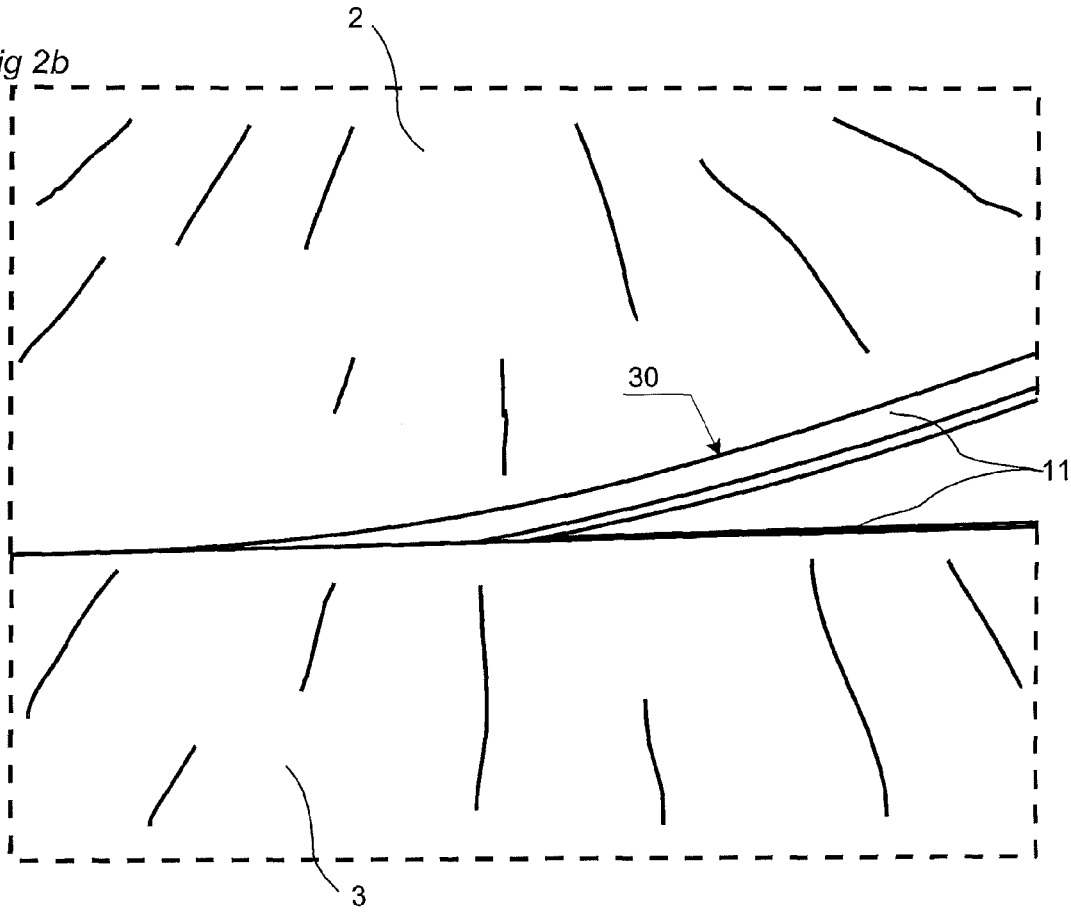
Figure 3A:
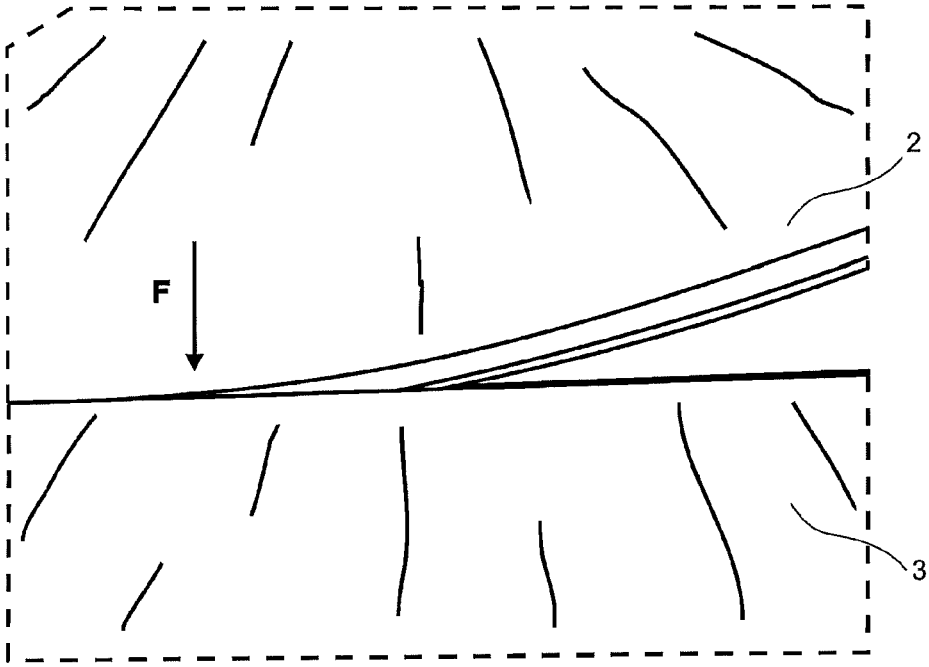
FIGS. 3*a*-3*b* show embodiments of the assembling method.

FIG. 2*a* shows the assembling from another view and FIG. 2*b* shows a detailed view of the bent (30) floorboard 2 edge and that a part of the edge is pressed down such that parts of the floorboards 2,3 are locked to each other by the mechanical locking system 11. The edge is pressed down by applying a vertical force F at the edge on the floorboard, as disclosed in FIG. 3*a*, on a part of the edge which is closest to said another edge, wherein the part of the edge is mechanically locked to another part of said another edge by the mechanically locking system 11. This is repeated until the whole edge is connected vertically and horizontally to said another edge.

The bending of the floorboard makes it possible to finalize the locking of only a part of the edge of the floorboard, instead of the whole edge as in the known methods, and as a result the force required to connect the floorboards is considerably reduced. Since only a part of the edge of the floorboard is locked the area in the mechanical locking system that is in contact during the connection is reduced and consequently the friction created in the mechanical locking is reduced and thereby the force required. The bending is preferably achieved by raising (R) an outer part of said edge by positioning of a raising device (25), e.g. a wedge, or a hand/finger of the assembler under said floorboard. The position of the raising device is maintained during the force-applying step.

Figure 3B:
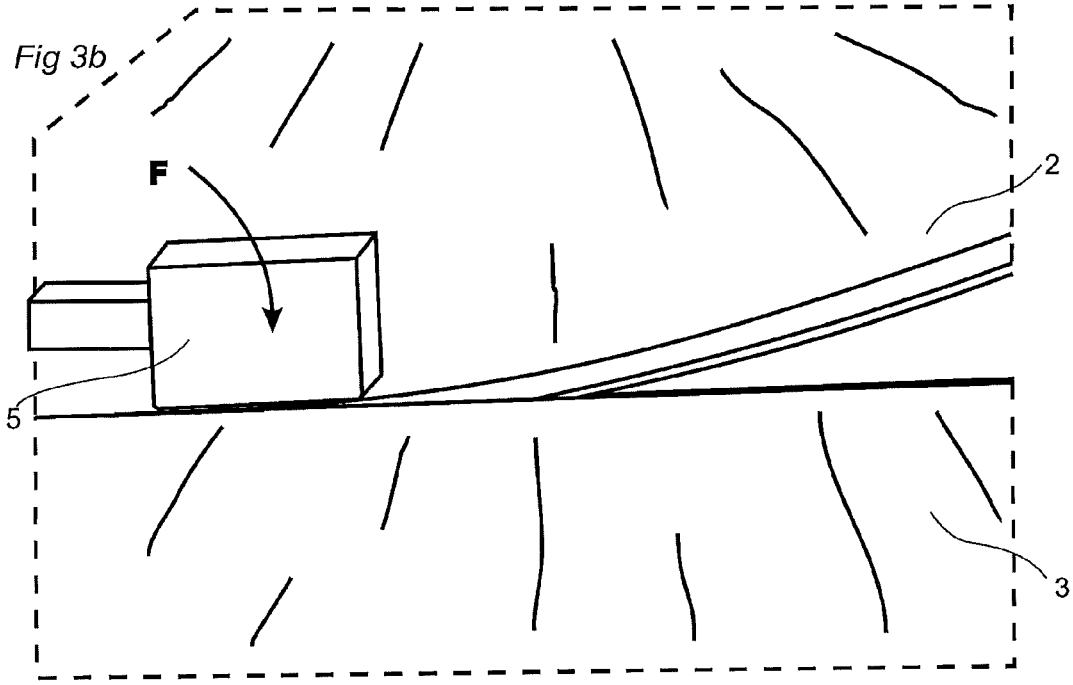
Figure 4A:
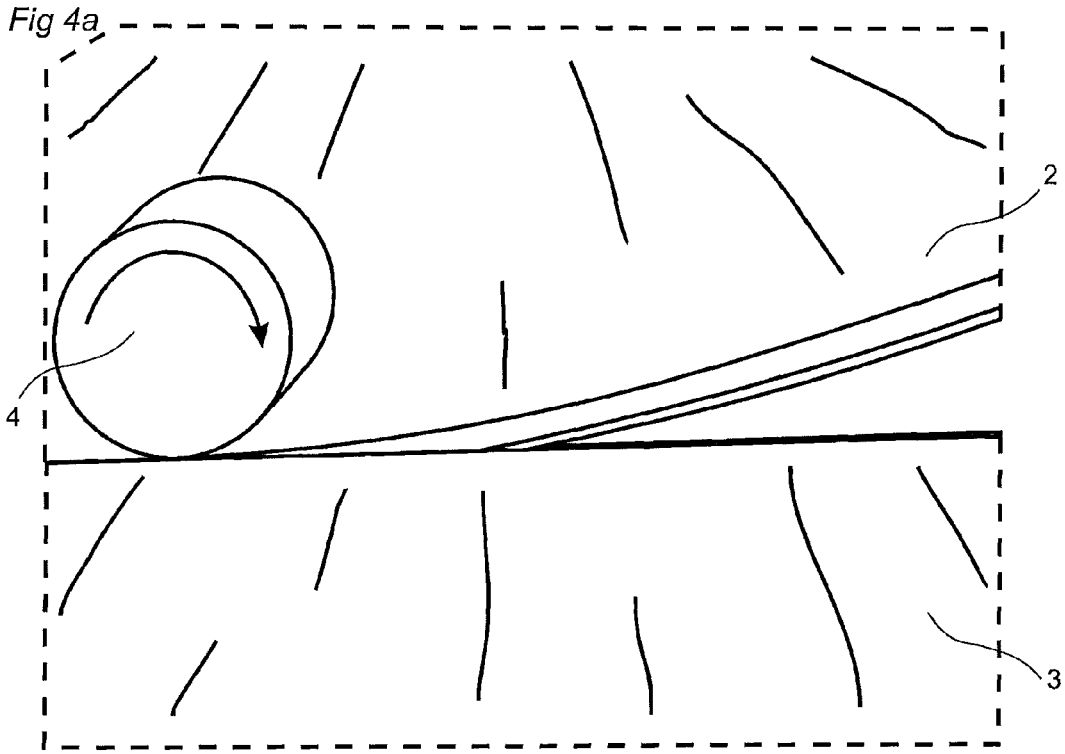
FIGS. 4*a*-4*b* show embodiments of the assembling method.
Figure 4B:
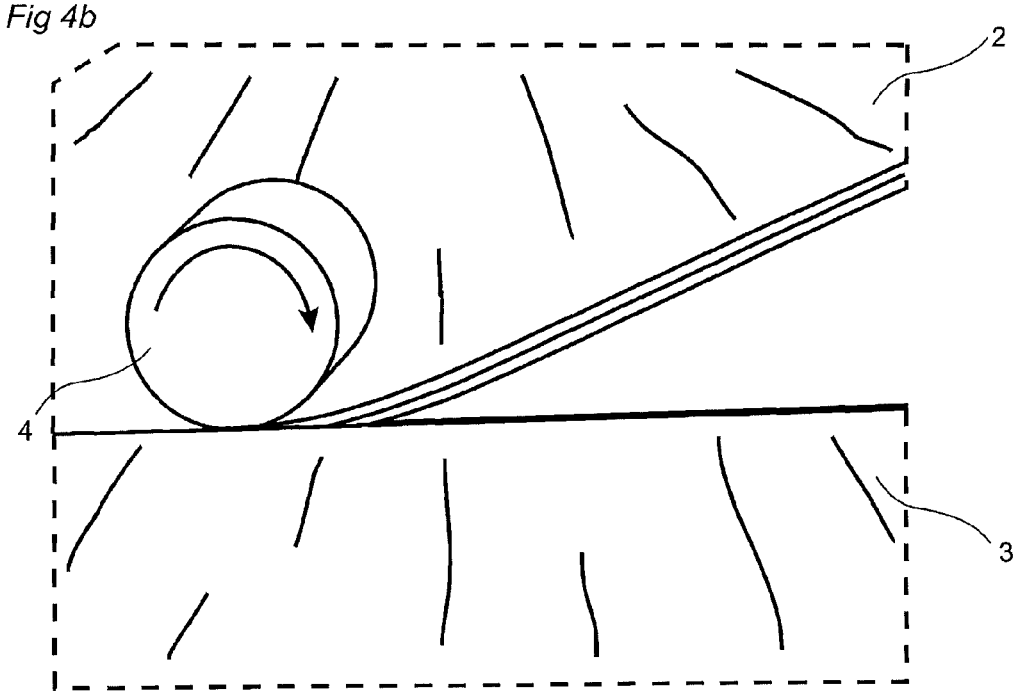

The force may be applied directly, without tools, on the floorboard e.g. by a hand or a foot of the assembler. However, a tool 4,5 may be used to apply the force as disclosed in FIGS. 3*b*, 4*a* and 4*b*. In FIG. 4*b* only a part of the floorboard is bent while the rest of the floorboard edge continues straight in the direction of the tangent of the bent part. Most preferably a tool with a rotatable press part is used to apply the force. FIG. 9*b* shows an embodiment of such a tool.

The floorboard-assembling tool in FIG. 9*b* comprises a handle 93 and press part 94, which is of a circular shape. The rotatable press part 94 makes it easy to move the tool, by one hand of the assembler, along the edge of the floorboard, which is going to be connected, and bend the floorboard with the other hand.

The mechanical angling locking system in FIG. 5*a-b* comprises a locking strip 51, a locking element 52 and a tongue groove 54 at an edge of a resilient floorboard 1 and a locking groove 53 and a tongue 55 at an edge of an adjacent resilient floorboard 2. The tongue 55 cooperates with the tongue groove 54 for vertical locking and the locking element 52 cooperates with the locking groove 53 for horizontal locking, similar to the angling locking systems disclosed in WO 01/77461.

Compared to the locking system, which is produced in a wood based core, disclosed in WO 01/77461 it is possible to produce a mechanical angling locking system in a resilient floorboard with a shorter locking strip and/or higher locking angle and/or increased locking surface area, as disclosed in FIG. 5*b*, which is an enlarged view of area 50 in FIG. 5*a*. This is due to the resilient material, which makes it possible to bend the locking strip more without breaking it. The angling locking system is preferably integrally formed in one piece with the resilient material of the floorboard.

Figure 6A:
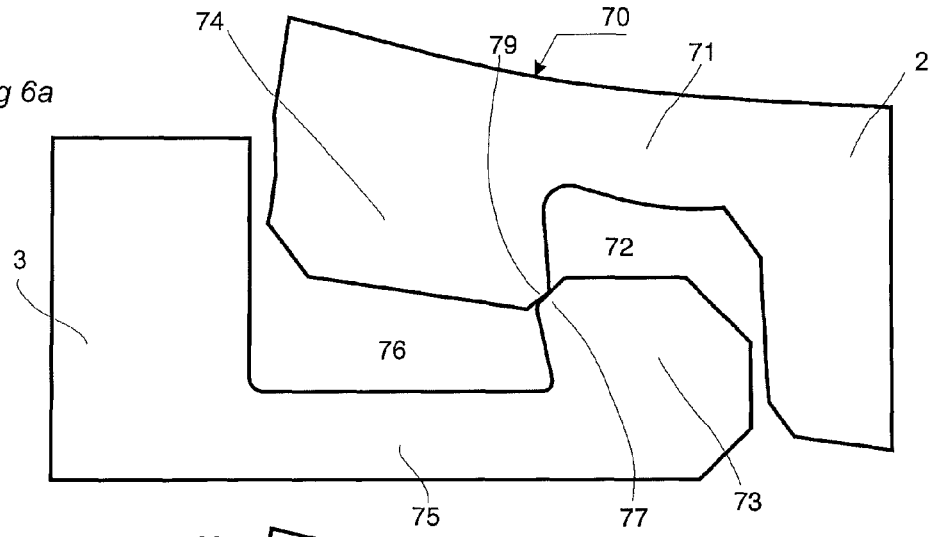
FIGS. 6*a*-6*c* show an embodiment of resilient floorboards during assembling.
Figure 6B:
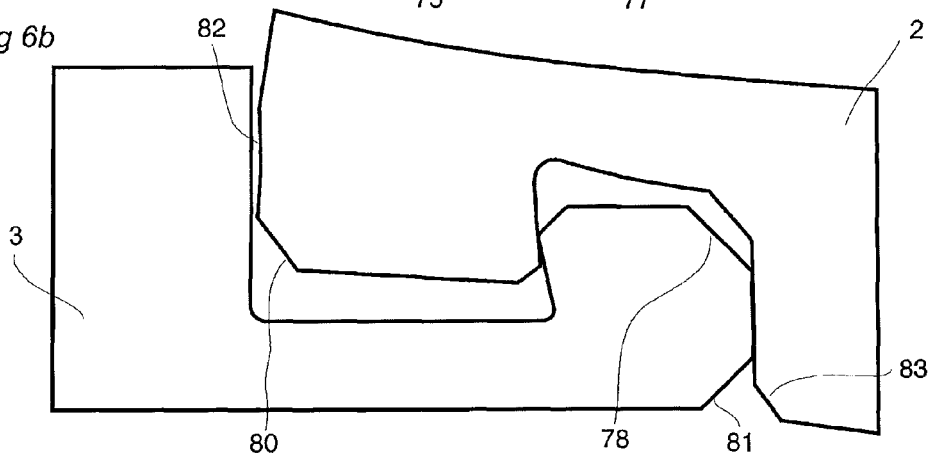
Figure 6C:
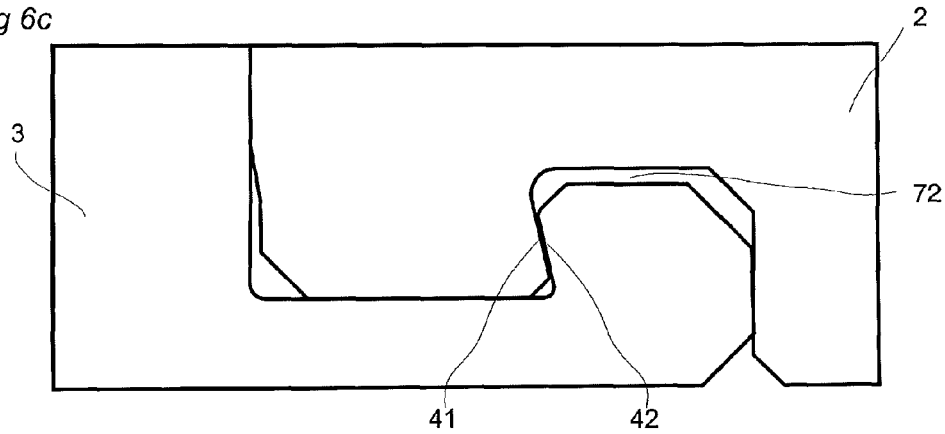

An embodiment of the mechanical locking system is disclosed in FIGS. 6*a*-6*c* in which figures a cross-section of the locking system is shown in three sequential steps during the connection. A first device of the mechanical locking system comprises an upper, and upwardly resiliently bendable, locking strip 71 at an edge of a floorboard 2 and a second device of the mechanical locking system comprises a lower locking strip 75 at an edge of another floorboard 3.

The upper and the lower locking strip is provided with a downwardly and an upwardly protruding locking element 74, 73 respectively. The locking elements are provided with locking surfaces 41, 42 configured to cooperate for horizontal locking of the floorboards.

An upwardly bending of the upper locking strip 71 across the edge (see FIG. 6*a*-6*b*), facilitates a positioning of the downwardly protruding locking element 74 between the upwardly protruding locking element and an upper edge of the floorboard 3 in a position where the locking surface cooperates, as shown in FIG. 6*c*.

The downwardly protruding locking element is preferably provided with a guiding surface 79, which is configured to cooperate (see FIG. 6*a*) with the upwardly protruding locking element 73 in order to facilitate the positioning.

Preferably, the upwardly protruding locking element 73 is provided with another guiding surface 77, which is configured to cooperate (see FIG. 6*a*) with the guiding surface 79 to further facilitate the positioning.

It is also possible to only provide the upwardly protruding locking element 73 with a guiding surface, which is configured to cooperate with an edge of the downwardly protruding locking element.

The angle 44 of the guiding surface 79 and the angle of 43 said another guiding surface 77 are preferably more than about 30° and most preferably more than about 45°.

In a preferred embodiment the mechanical locking system is provided with one or more additional guiding surfaces, which guide the floorboards to the correct location for connection:

- A guiding surface 80 at the downwardly protruding locking element, which guiding surface cooperates with an upper edge of the said other floorboard.
- A guiding surface 83 at the lower edge of the floorboard, which guiding surface cooperates with an edge or a guiding surface of the upwardly protruding locking element.

A space 81, shown in FIG. 6*b*, under the upwardly protruding locking element facilitates bending of the lower locking strip during the connection of the lower locking strip. A space 72 above the upwardly protruding locking element ensures a proper connection of the floorboards, without risking that the floorboard is prevented reaching the position were the upper surfaces of the floorboards are in the same plane.

Figure 7A:
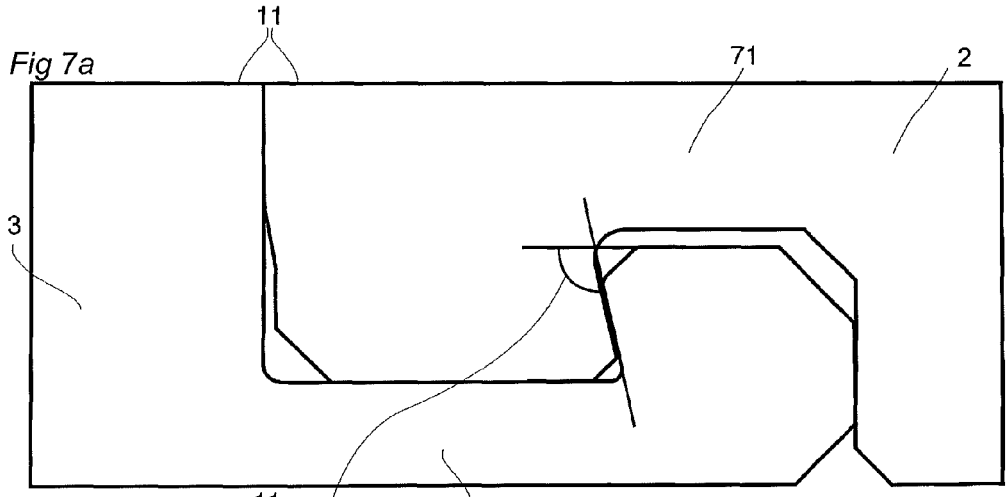
FIGS. 7*a*-*c* show embodiments of a locking system for resilient floorboards.
Figure 7B:
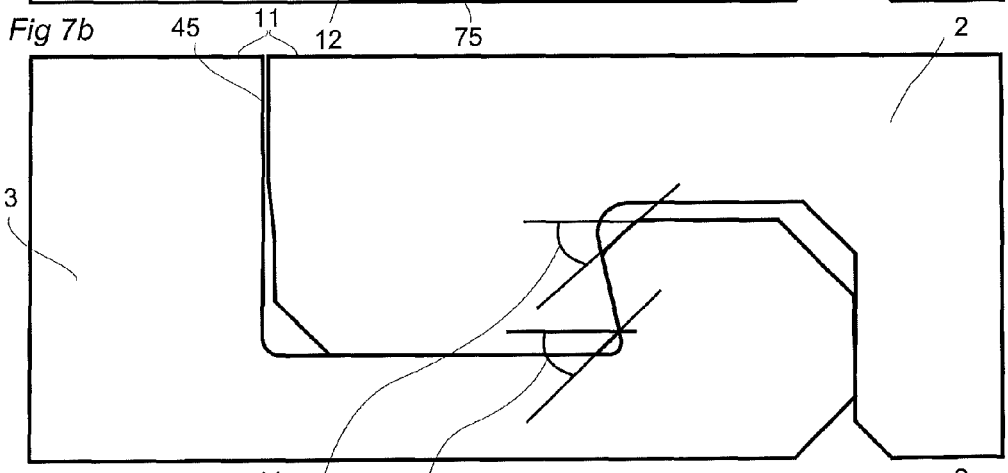
Figure 7C:
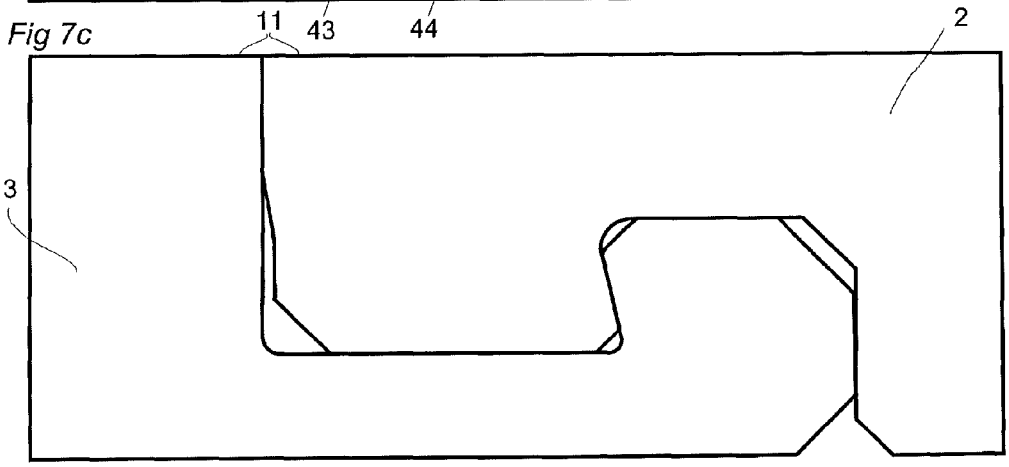
Figure 8A:
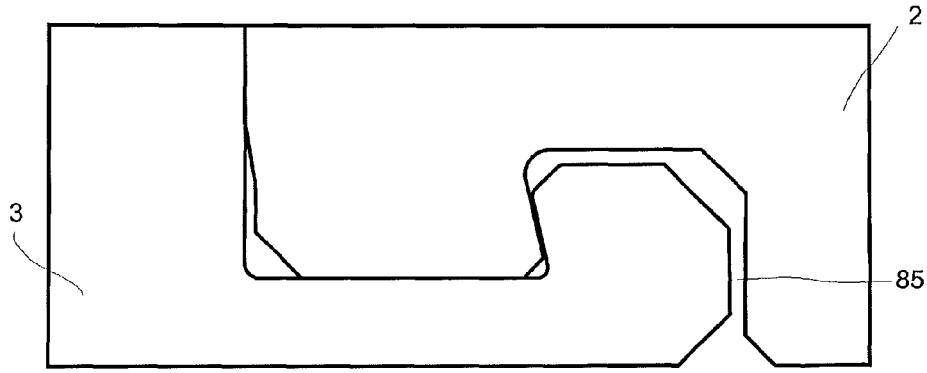
FIGS. 8*a*-8*c* show embodiments of a locking system for resilient floorboards
Figure 8B:
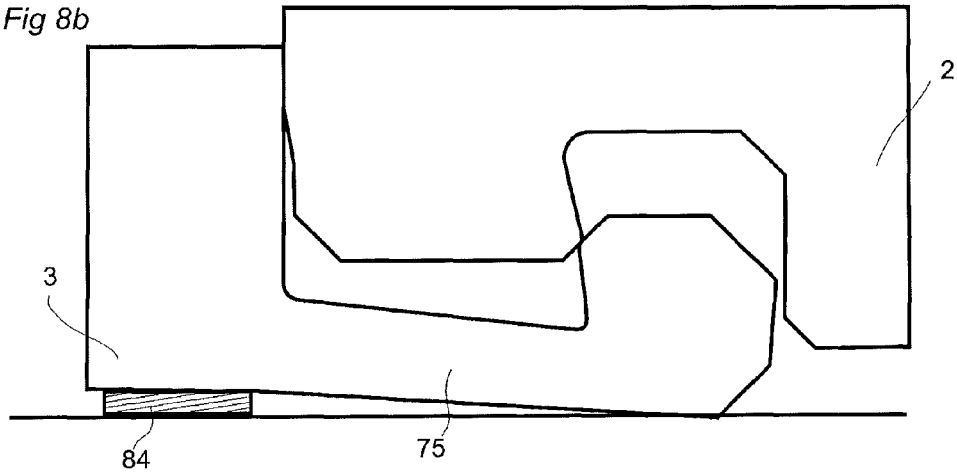
Figure 8C:
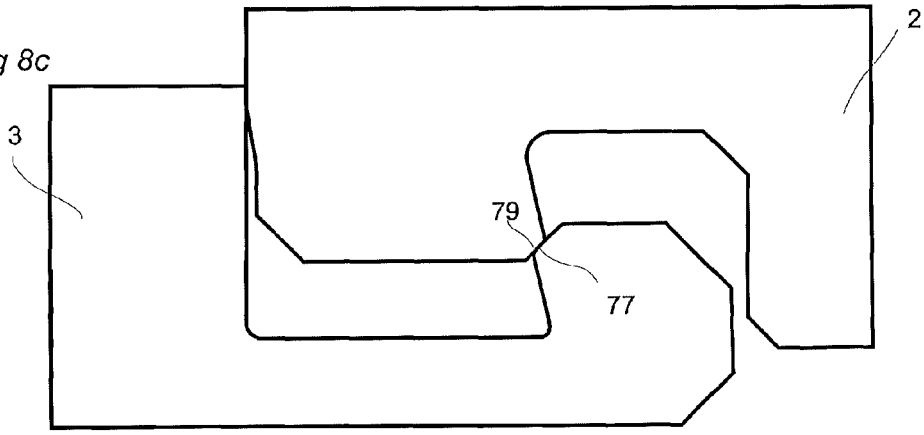

The number and area of the contact and locking surfaces should generally be minimized to ease connection of the floorboards. A small play 45 between the top edges of the floorboards (see FIG. 7*b*, 45) makes them easier to install, but a tight (see. FIG. 7*a*) fit increases the vertical locking strength. To achieve a connection which is more resistant to moisture it is possible to have contact surfaces and a tight fit between the between the lower edges of the floorboards, which also increases the vertical and horizontal locking strength. However, the tight fit also makes it harder to connect the floorboards and a space (see FIG. 8*a-c*, 85) makes it easier. An even more moisture resistant connection is achieved if the space 72 above the upwardly protruding locking element is eliminated (see FIG. 7*c*).

The angle 12 between the locking surfaces and the upper surface of the floorboards are preferably more than 90° to obtain a vertical locking in the position where the locking surface cooperates.

The locking strips 71, 75 are integrally formed in the floorboard, and preferably the whole locking system is integrally formed in one piece with the resilient material of the floorboard. However, it is possible to add separate pieces to increase the locking strength, e.g. in the form of a tongue of stiffer material, of e.g. plastic or metal of e.g. aluminium, preferably for the vertical locking.

A downwardly bending across edge of the lower locking strip 75 (see FIG. 8*b*) further facilitates the positioning of the locking elements in the position where the locking surface cooperates. Bending of the lower strip is preferably achieved by positioning of a spacer 84 between the floorboard edge and the subfloor, and inside the lower locking strip such that the lower locking strip can bend freely. It is also possible to produce a lower locking strip whose lower part is removed to create a free space between the subfloor and lower the locking strip. However, that also reduces the bending strength of the locking strip, which is not desirable since a locking strip of resilient material, e.g. vinyl, has a relatively weak resilient strength. A reduced bending strength of the locking strip means a reduced locking strength of the locking system.

Figure 9A:
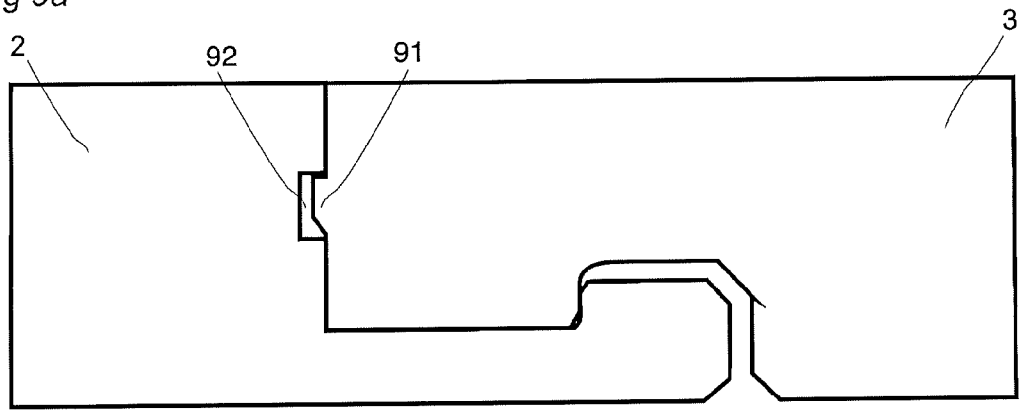
FIGS. 9*a-b* show an embodiment of a locking system and an embodiment of the assembling tool.
Figure 9B:
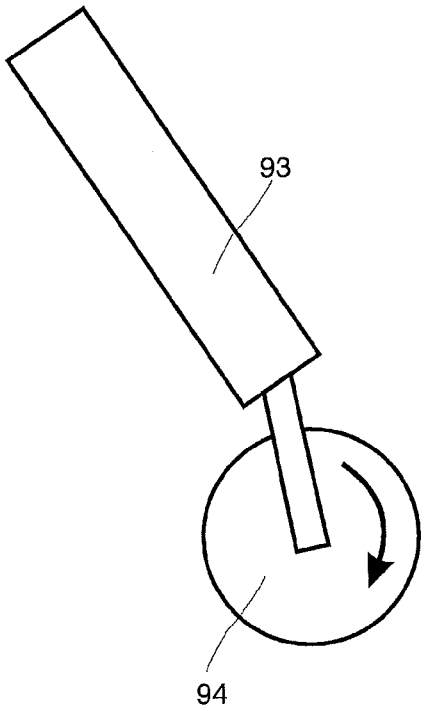

FIG. 9*a* shows an embodiment comprising a tongue 91 at the edge of a floorboard, cooperating with a tongue groove 92 at the edge of an adjacent floorboard, cooperating for vertical locking of the floorboards. The embodiment in FIG. 9*a* is provided with the tongue at the edge of the floorboard with the upper locking strip and the tongue groove at the edge of the floorboard with the lower locking strip. However it is also possible to provide the tongue at the edge of the floorboard with the lower locking strip and the tongue groove at the edge of the floorboard with the upper locking strip. These embodiments may be combined with the locking surface angle 12 that is more than 90°, as disclosed in FIGS. 6*a* to 8*c*, to obtain an increased vertical locking in the position where the locking surface cooperates.

The invention claimed is:

1. A method of assembling resilient floorboards, which are provided with a mechanical locking system for vertical and horizontal locking of two adjacent floorboards, wherein the method comprises the steps of:

positioning a first floorboard edge of a first floorboard, provided with a first device of said mechanical locking system, juxtaposed a second edge of a second floorboard, provided with a second device of said mechanical locking system, so that the first device of the mechanical locking system overlies the second device, the first floorboard edge having an outermost surface closest to the second edge of the second floorboard;

bending the first floorboard along at least the outermost surface of the first floorboard edge above the top surface of the second floorboard while the first device of the mechanical locking system overlies the second device; and applying a force on a first part of the first floorboard edge, wherein at said first part of the first floorboard edge said first device is pushed into said second device to obtain a vertical and horizontal mechanical locking of a part of the first and second edges.

2. The method according to claim 1, wherein the bending is achieved by raising at least a part of the outermost surface of said first floorboard edge.

3. The method according to claim 2, wherein the raising is achieved by positioning of a raising device under said first floorboard in order to raise the part of the outermost surface of the first floorboard edge with respect to the juxtaposed second edge of the second floorboard.

4. The method according to claim 1, wherein the method comprises the step of applying a force to a new part of the first floorboard edge, which new part is adjacent to said first part to reduce the overall force required to mechanically lock the first floorboard edge to said second edge of the second floorboard, and repeating this step until the whole first floorboard edge is vertically and horizontally locked to said second edge.

5. The method according to claim 1, wherein the force is applied to a part of the first floorboard edge that is unlocked and closest to said second edge.

6. The method according to claim 1, wherein the force is applied by a tool.

7. The method according to claim 6, wherein the force is applied by a rotating part of the tool.

8. The method according to claim 1, wherein the method comprises the step of bending of a floorboard across said first floorboard edge and/or said second edge.

9. The method according to claim 1, wherein the method comprises the step of connecting an adjacent edge of the first floorboard to a juxtaposed edge of a third floorboard in another row by angling.

10. The method according to claim 1, wherein the first device comprises an upper locking strip and the second device comprises a lower locking strip, which upper and lower locking strips are integrally formed in the floorboards, the upper and the lower locking strips are provided with a downwardly and an upwardly protruding locking element respectively, each locking element provided with a locking surface configured to cooperate for horizontal locking of the floorboards, wherein the upper locking strip is upwardly resiliently bendable in order to facilitate a positioning of the downwardly protruding locking element, between the upwardly protruding locking element and an upper edge of the second floorboard, into a position where the locking surfaces cooperate.

11. The method according to claim 10, wherein the lower locking strip is downwardly resiliently bendable in order to facilitate the positioning.

12. The method according to claim 10, wherein the downwardly protruding locking element is provided with a first guiding surface, which is configured to cooperate with the upwardly protruding locking element in order to facilitate the positioning.

13. The method according to claim 12, wherein the first guiding surface cooperates with another guiding surface of the upwardly protruding locking element, which said another guiding surface is configured to facilitate the positioning.

14. The method according to claim 12, wherein the angle of the first guiding surface is more than about 30°.

15. The method according to claim 12, wherein the angle of the first guiding surface is more than about 45°.

16. The method according to claim 13, wherein the angle of said another guiding surface is more than about 30°.

17. The method according to claim 13, wherein the angle of said another guiding surface is more than about 45°.

18. The method according to claim 10, wherein the angle between the locking surfaces and the upper surface of the floorboards are more than 90° to obtain a vertical locking in the position where the locking surfaces cooperate.

19. The method according to claim 10, wherein the edge of the first floorboard is provided with a tongue and the edge of said second floorboard is provided with a groove for vertical locking of the floorboards.

20. The method according to claim 10, wherein the edge of the first floorboard is provided with a groove and the edge of said second floorboard is provided with a tongue for vertical locking of the floorboards.

21. The method according to claim 11, the method further comprising bending the lower locking strip.

22. The method according to claim 21, wherein the bending of the lower locking strip is achieved by positioning a spacer between the second floorboard and the subfloor and offset from the lower locking strip such that the lower locking strip can bend freely.

23. The method accordingly to claim 21, wherein the bending of the lower locking strip is achieved by the lower locking strip whose including a lower part having a free space between the subfloor and a bottom of the lower locking strip.

24. The method according to claim 22, wherein the bending of the first floorboard is achieved by raising at least a part of the outermost surface of said first floorboard edge with a raising device positioned under said first floorboard in order to raise the part of the outermost surface of the first floorboard edge with respect to the juxtaposed second floorboard edge.

25. A method of assembling resilient floorboards, which are provided with a mechanical locking system for vertical and horizontal locking of two adjacent floorboards, wherein the method comprises the steps of:

positioning a first edge of a first floorboard, provided with a first device of said mechanical locking system, juxtaposed a second edge of a second floorboard, provided with a second device of said mechanical locking system;

bending the first floorboard along the first edge so that the first edge has an axis of curvature that is perpendicular to the second edge of the second floorboard, the axis of curvature being convex toward the bottom surface of the floorboards; and applying a force on a first part of the first edge, wherein at said first part of the first edge said first device is pushed into said second device to obtain a vertical and horizontal mechanical locking of a part of the first and second edges.

26. The method according to claim 25, wherein the bending is achieved by raising at least a part of the outermost surface of said first edge of said first floorboard.

27. The method according to claim 26, wherein the raising is achieved by positioning of a raising device under said first floorboard in order to raise the part of the outermost surface of the first edge of the first floorboard with respect to the juxtaposed second edge of the second floorboard.

28. The method according to claim 25, wherein the method comprises the step of applying a force to a new part of the first edge of the first floorboard, which new part is adjacent to said first part to reduce the overall force required to mechanically lock the first edge to said second edge of the second floorboard, and repeating this step until the whole first edge of the first floorboard is vertically and horizontally locked to said second edge of the second floorboard.

29. The method according to claim 25, wherein the force is applied to a part of the first edge of the first floorboard that is unlocked and closest to said second edge of the second floorboard.

30. A method of assembling resilient floorboards, which are provided with a mechanical locking system for vertical and horizontal locking of two adjacent floorboards, wherein the method comprises the steps of:

positioning a first edge of a first floorboard, provided with a first device of said mechanical locking system, juxtaposed a second edge of a second floorboard, provided with a second device of said mechanical locking system, so that the first device of the mechanical locking system overlies the second device, the first edge having an outermost surface closest to the second edge of the second floorboard; and applying a force on a first part of the first edge of the first floorboard such that the first floorboard bends along at least the outermost surface of the first edge, thereby at said first part of the first edge said first device is pushed into said second device to obtain a vertical and horizontal mechanical locking of a first part of the first and second edges, and at a second part of the first edge of the first floorboard, said first device is positioned above said second device such that a second part of the first and second edges remains in an unlocked position.

31. The method according to claim 30, wherein the bending of the first floorboard is achieved by raising at least a part of the outermost surface of said first edge of said first floorboard.

32. The method according to claim 31, wherein the raising is achieved by positioning of a raising device under said first floorboard in order to raise the part of the outermost surface of the first edge of the first floorboard with respect to the juxtaposed second edge of the second floorboard.

33. The method according to claim 30, wherein the method comprises the step of applying a force to a new part of the first edge of the first floorboard, which new part is adjacent to said first part to reduce the overall force required to mechanically lock the first edge to said second edge of the second floorboard, and repeating this step until the whole first edge of the first floorboard is vertically and horizontally locked to said second edge of the second floorboard.

34. The method according to claim 30, wherein the force is applied to a part of the first edge of the first floorboard that is unlocked and closest to said second edge of the second floorboard.

* * * * *